US006895855B2

(12) United States Patent
Doll

(10) Patent No.: US 6,895,855 B2
(45) Date of Patent: May 24, 2005

(54) HYDRAULIC MOTORS AND PUMPS WITH ENGINEERED SURFACES

(75) Inventor: Gary L. Doll, Canton, OH (US)

(73) Assignee: The Timken Company, Canton, OH (US)

( * ) Notice: Subject to any disclaimer, the term of this patent is extended or adjusted under 35 U.S.C. 154(b) by 18 days.

(21) Appl. No.: 10/244,929

(22) Filed: Sep. 16, 2002

(65) Prior Publication Data

US 2003/0063980 A1 Apr. 3, 2003

Related U.S. Application Data

(60) Provisional application No. 60/326,312, filed on Oct. 1, 2001.

(51) Int. Cl.[7] ..... F01B 1/00

(52) U.S. Cl. ..... 92/72; 92/58; 91/491

(58) Field of Search ..... 92/72, 58; 91/491, 91/492, 493, 494, 495, 496, 497, 498; 417/273

(56) References Cited

U.S. PATENT DOCUMENTS

| | | | | |
|---|---|---|---|---|
| 2,461,235 | A | * 2/1949 | Raymond | 417/273 |
| 2,958,555 | A | * 1/1961 | Bendler et al. | 430/323 |
| 3,187,681 | A | * 6/1965 | Firth et al. | 91/498 |
| 3,922,956 | A | 12/1975 | Foster | |
| 3,961,558 | A | * 6/1976 | Dokukin et al. | 91/491 |
| 4,008,015 | A | 2/1977 | McDermott | |
| 4,491,500 | A | 1/1985 | Michaud et al. | |
| 4,619,865 | A | 10/1986 | Keem et al. | |
| 4,716,083 | A | 12/1987 | Eichen et al. | |
| 4,724,042 | A | 2/1988 | Sherman | |
| RE34,035 | E | 8/1992 | Dimigen et al. | |
| RE34,272 | E | 6/1993 | Michaud et al. | |
| 5,266,409 | A | 11/1993 | Schmidt et al. | |
| 5,477,976 | A | 12/1995 | Suzuki et al. | |
| 5,638,600 | A | 6/1997 | Rao et al. | |
| 5,672,054 | A | 9/1997 | Cooper et al. | |
| 5,750,210 | A | 5/1998 | Schmidt et al. | |
| 5,780,119 | A | 7/1998 | Dearnaley et al. | |
| 5,947,710 | A | 9/1999 | Cooper et al. | |
| 5,979,295 | A | 11/1999 | Larker et al. | |
| 6,071,103 | A | 6/2000 | Hirano et al. | |
| 6,165,616 | A | 12/2000 | Lemelson et al. | |
| 6,200,675 | B1 | 3/2001 | Neerinck et al. | |
| 6,217,415 | B1 | 4/2001 | Ajayi | |
| 6,228,471 | B1 | 5/2001 | Neerinck et al. | |
| 6,293,764 | B1 | * 9/2001 | Baumann | 417/273 |
| 6,299,425 | B1 | 10/2001 | Hirano et al. | |

FOREIGN PATENT DOCUMENTS

| | | |
|---|---|---|
| DE | 3926185 | 2/1991 |
| DE | 10039169 | 3/2001 |
| DE | 19961400 | 7/2001 |
| EP | 0785359 | 7/1997 |
| JP | 05071528 | 3/1993 |

OTHER PUBLICATIONS

Holmberg and A. Matthews, Coatings Tribology: Properties, Techniques and Applications in Surface Engineering (Elsevier, New York, 1994), pp. 213–236.

* cited by examiner

*Primary Examiner*—Edward K. Look
*Assistant Examiner*—Michael Leslie
(74) *Attorney, Agent, or Firm*—Polster, Lieder, Woodruff & Lucchesi, L.C.

(57) ABSTRACT

Engineered surface treatments are applied to different types of hydraulic motors and pumps to improve the life of the contacting surfaces in said motors and pumps. The engineered surface treatments are selected from texture modifications and tribiological coatings and selectively applied to one or both of the contacting surfaces to reduce friction and improve fatigue life under poor lubrication operating conditions.

4 Claims, 3 Drawing Sheets

HYDRAULIC MOTORS AND PUMPS WITH ENGINEERED SURFACES

CROSS-REFERENCE TO RELATED APPLICATIONS

This application is a non-provisional patent application based upon provisional patent application having Ser. No. 60/326,312, filed Oct. 1, 2001, and which is incorporated herein by reference.

STATEMENT REGARDING FEDERALLY SPONSORED RESEARCH OR DEVELOPMENT

Not Applicable.

1. Technical Field of the Invention

The present invention relates the treatment of metallic surfaces on hydraulic motors and pumps to improve the life, improve load bearing capability and to provide wear resistance for said surfaces using engineered surface treatment techniques.

2. Background of the Invention

Hydraulic motors are actuators that convert hydraulic pressure into continuous rotational movement. They are the same as hydraulic pumps except pumps are used to convert mechanical (rotary) energy into hydraulic energy. There are three basic types of hydraulic motors and pumps: piston type, vane type and gear type.

Piston-type motors and pumps are those most commonly used in hydraulic systems. The radial-piston motor operates in reverse of the radial-piston pump. In the radial-piston pump, as the cylinder block rotates, the pistons press against the rotor and are forced in and out of the cylinders, thereby receiving fluid and pushing it out into the system. In the radial piston motor, fluid is forced into the cylinders and drives the pistons outward. The pistons pushing against the rotor cause the cylinder block to rotate.

The axial-piston motor or pump is often used as a part of variable speed gear, such as anchor windlasses, cranes, winches and the power transmitting unit in steering engines. Hydraulic fluid introduced under pressure to a cylinder tries to push the piston out of the cylinder. In being pushed out, the piston, through its piston rod, will seek the point of greatest distance between the top of the cylinder and the socket ring. The resultant pressure of the piston against the socket ring will cause the pressure plate and the socket ring to rotate.

In a typical vane-type air motor or pump, the rotating element is a slotted rotor that is mounted on a drive shaft. Each slot of the rotor is fitted with a freely sliding rectangular vane. The rotor and vanes are enclosed in the housing, the inner surface of which is offset from the drive shaft axis. When the rotor is in motion, the vanes tend to slide outward due to centrifugal force. The vane motor operates on the principle of differential areas. When compressed air is directed into an inlet port, its pressure is exerted equally in all directions. The vanes define differential areas in the motor, which provides force differentials between the large and small areas. The potential energy of the compressed air is thus converted into kinetic energy in the form of rotary motion and force.

For simple systems with a relatively low level of pressure (about 140 to 180 bar or 14 to 18 MPa) the gear motor or pump is the most commonly used type. A typical variety of gear motor or pump has an inner gear (or cam) with fewer lobes than an outer gear. By simultaneously increasing and decreasing oil pressure at specific locations, a differential oil pressure causes the gears to move relative to each other. The relative contact between the gears is mostly sliding. Rollers are sometimes included in gear motors. This type gear motor operates similarly to other gear motors, except rolling instead of sliding contact exists between the inner gear and the rollers.

Engineered surface treatments can be grouped as those treatments that alter the surface texture of the component, and those treatments that change the surface chemistry of the component. Examples of treatments that modify the surface texture are those that involve mechanical or chemical/mechanical polishing. Texture modifications include mechanical vibratory finishing, chemical-mechanical vibratory finishing, laser texturing, stone honing, and mechanical dimpling. Some specific processes and chemical compositions for chemical/mechanical polishing are described in Sherman U.S. Pat. No. 4,724,042; Michaud U.S. Pat. No. 4,491,500 and U.S. Pat. No. Re.34,272; Suzuki U.S. Pat. No. 5,477,976; and Ajayi U.S. Pat. No. 6,217,415, the contents of which are incorporated herein by reference. Examples of treatments that change the surface chemistry are tribological coatings or ion implanted surfaces. Tribiological coatings include doped amorphous carbons, undoped amorphous carbons, amorphous hydrocarbons, metal carbides, metal nitrides, metal oxides, metal dichalcogenides, and metal borides. Some of the most useful tribological coatings for mechanical components belong to the family of amorphous hydrocarbon materials. Compositions of amorphous hydrocarbon coatings are described by K. Holmberg and A. Matthews, Coatings Tribology: Properties, Techniques, and Applications in Surface Engineering. (Elsevier, New York, 1994), pp. 213–236.; Dimigen U.S. Pat. No. Re. 34,035; Neerinck U.S. Pat. Nos. 6,200,675 & 6,228,471; Lemelson U.S. Pat. No. 6,165,616; Dearnaley U.S. Pat. No. 5,780,119; and Schmidt U.S. Pat. Nos. 5,266,409 & 5,750,210, the contents of which are incorporated herein by reference. Other useful tribological coatings belong to the family of amorphous boron carbides, described by Eichen U.S. Pat. No. 4,716,083 and Keem U.S. Pat. No. 4,619,865, the contents of which are incorporated herein by reference.

SUMMARY OF THE INVENTION

Performance limitations exist for hydraulic motors and pumps. These limitations are due in most cases to the type of tribological contact and lubrication regime that the moving components of the motors or pumps are experiencing. In hydraulic motors and pumps, two types of contact dominate: rolling and sliding. Also, lubricant films at the sliding and rolling contacts are usually thin enough in hydraulic motors and pumps to classify the lubrication regime as a "boundary layer type." It is a principal and specific objective of this invention to selectively apply the most effective type of engineered surface treatment to'the contacting surfaces of the different types of hydraulic motors and pumps to best address the contact type and lubrication regime limitations.

It also is an object to discuss the functionality of engineered surface treatments to improve the tribological situations of rolling and sliding contact in a "boundary layer" lubrication regime. Finally it is an object to identify the limitations of the three main types of hydraulic motors and pumps, and to specify the preferred engineered surface treatment solutions to those limitations Other advantages and features will become apparent from drawings, the following detailed description of the invention, and from the claims.

DESCRIPTION OF THE DRAWINGS

In the drawings wherein like numbers and letters refer to like parts wherever they occur.

DETAILED DESCRIPTION

Rolling Contacts

Lubrication regimes are best characterized by the dimensionless parameter λ, which is the ratio of the lubricant film thickness (d) to the composite rms roughness of the mating surfaces ($\sigma_1$, $\sigma_2$). That is, $$\lambda = \frac{d}{\sqrt{\sigma_1^2 + \sigma_2^2}}.$$

The lubricant film thickness is a function of its viscosity and the entrainment velocity of the moving component contacts, among other things. So the more rapidly the components move relative to each other and the greater the lubricant viscosity, the thicker the lubricant film. This is the concept of hydrodynamic lubrication. The relative component velocities in hydraulic motors and pumps are much smaller than they are in rolling element bearings for example. Therefore, the lubricant film thickness generated by hydraulic component velocities is much thinner than desirable. The lubricant film thickness could be increased somewhat by using oils with large viscosity; however, a larger lubricant viscosity also means that the motor is running less efficiently due to parasitic frictional losses in the lubricant.

Figure 1:
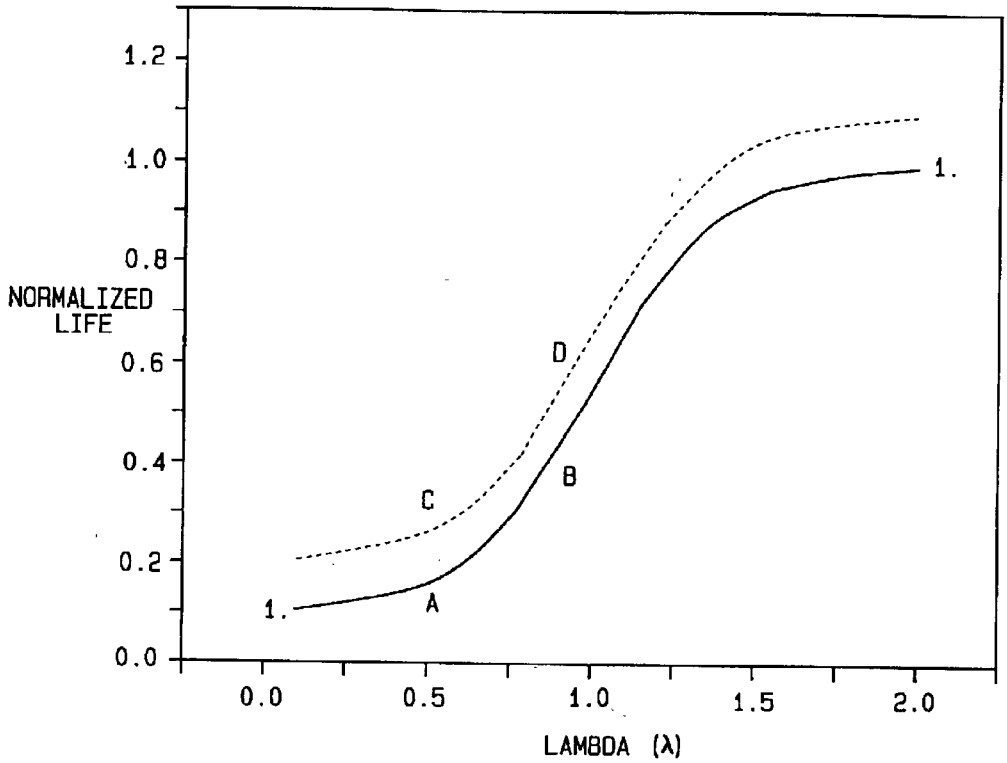
FIG. 1 is a graph depicting the relationship between the λ of a pair of rolling contacts to the life of the contacts in a well lubricated regime.

In FIG. 1, the lambda (λ) value is plotted on the ordinate axis and the vertical axis is designated "normalized life" which is the percentage of the component life compared to the component life in a well lubricated regime.

The rolling contact fatigue life of a component at a given load depends strongly upon the λ value of the system. This is shown graphically in FIG. 1 as the solid line, 1.–1. The λ value of rolling contacts in hydraulic motors and pumps is typically less than about 0.5. This condition is labeled as point A on the curve, and it correlates to a relative fatigue life of about 16%. That is, the life of the component experiencing rolling contact in hydraulic motors or pumps is typically about 16% of the component life if it were operating in a well-lubricated regime.

The application of a texture modification process to the rolling surfaces of hydraulic components can reduce the surface roughness, increase the compressive stress of the surface, and typically increase λ by up to 75%. This increases λ to about 0.9, and that condition is labeled as point B on the solid curve in FIG. 1. Point B correlates to a relative life of about 43%, or an increase in the life of the motor by about 170% relative to point A.

The application of a suitable tribological coating to one or more of the contacting surfaces provides an increased life of the system described by the dashed line in FIG. 1. The selection of the tribological coating depends upon whether it is to be applied to the piece that experiences the fatigue, or to the contacting piece that causes the fatigue, since different coating properties are required. At a λ value of 0.5, point C indicates that the relative fatigue life of a component with a tribological coating increases to about 26% or about a 60% improvement over the life corresponding to point A.

The combination of a texture modification and tribological coating to one or both of the contacting surfaces corresponds to point D on the life curve. This yields a relative fatigue life of about 53%, or about a 225% improvement over the life corresponding to point A.

Sliding Contacts

Surfaces sliding together under high loading and poor lubrication can experience adhesive wear, sometimes referred to as scuffing or galling. Interfacial adhesive junctions that form if solid surfaces are in contact on a microscopic scale initiate adhesive wear processes. As a normal load is applied, local pressure at the asperities becomes extremely high, and the asperities deform plastically until the real area of contact has increased enough to support the applied load. In the absence of surface films, the surfaces adhere together. In "boundary layer" lubrication, tangential motion at the interface causes lubricant films to disperse at the point of contact, and cold welding of the junctions takes place. Continued sliding causes the junctions to be sheared and new junctions to be formed. This chain of events leads to the generation of wear particles, the accelerated adhesion and fracture of the mating surfaces, and scuffing and galling can ensue.

Texture modifications of sliding surfaces work to inhibit scuffing or galling in "boundary layer" lubrication. Texture modification processes can reduce the asperity heights of the surfaces, as well as provide miniature reservoirs to trap lubrication and keep a film present in the interface.

Tribological coatings can also provide miniature reservoirs to trap lubrication on sliding surfaces, but they work in other ways to provide barriers against adhesive wear. A tribological coating applied to one or both sliding surfaces can provide a barrier to the formation of cold junctions by forming a low shear surface or a chemical barrier against the diffusion of atoms of one surface into the other. A tribological coating applied to one sliding surface can also serve to polish the uncoated opposite surface, thereby decreasing the asperity height and increasing the lambda value.

Following are specific examples of different types of motors and pumps with the area of sliding or rolling contact indicated. The specific engineered surface treatment, i.e., texture modification and/or tribological coating, applied to the particular surface areas are identified as such in the attached drawing FIGS. 2–6.

Radial Piston Motors and Pumps

In a radial piston motor or pump (FIG. 2), rolling contact exists between the rollers and the cam lobes, and sliding contact exists between the rollers and the pistons. Under normal operating conditions, a thin lubricant film exists at the roller-cam interface and the roller-piston interface. Even so, the lubricant film is usually not thick enough to keep asperities from opposing surfaces from contacting during operation. Under these conditions, the system is in "boundary layer" lubrication.

Figure 2:
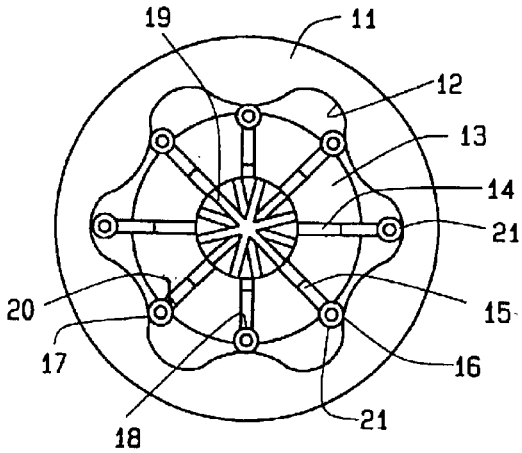
FIG. 2 shows the application of engineered surface treatment to a radial motor or pump.

In FIG. 2, a cam ring is designated 11 and has on its inside an undulated cam surface 12. A cylinder block 13 is fitted with cylinders 14 which are directed radially outward. Eight cylinders are shown but the number may vary. The cam ring 11 and the cylinder block 13 are concentric, and/or coaxial and rotatable relative to each other. In each cylinder 14 moves a piston 15 which on its outer end facing the cam ring 11 is slidingly arranged against a cam roller 16 which, in turn, abuts against and moves rollingly against the cam surface 12 of the cam ring 11. A distributing valve (not shown) distributes the hydraulic medium via ducts 19 to the cylinders 14 in their working stroke and evacuates the hydraulic medium from the cylinders 14 in their return stroke.

Thus there are possible adhesive wear conditions at the roller-cam interfaces 17 and the roller-piston interfaces 18.

The goals of engineered surface treatments are to promote rolling contact at the cam-roller interfaces 17; to reduce friction at the roller-piston interfaces 18; and reduce the adhesive wear interactions at those interfaces. In a low λ condition, a low friction coating applied to the roller 16 could reduce friction at the roller-retainer interface 18, but could at the same time promote sliding at the roller-cam interface 17 by reducing the traction force responsible for rolling. A better tribological solution is to apply a low friction coating 20 to the piston 15, and a texture modification 21 to the roller body 16. The coating 20 serves to maintain a low friction coefficient and eliminate adhesive wear at the roller-piston interface 18 as λ becomes small, enabling the roller 16 to maintain rolling contact with the cam surface 12. The texture modification treatment 21 applied to the rollers 16 increases λ slightly, decreasing the amount of adhesive wear between the roller 16 and the cam 12 at the roller-cam interface 17.

EXAMPLE NO. 1

Following is a specific example whereby a surface engineering technique is used to improve the operational performance of a radial piston motor. In this example, the motor manufacturer was treating the rollers 16 with an amorphous hydrocarbon-based (a-C:H) coating containing nanocrystalline tungsten carbide particles. This type of coating is commonly expressed as WC-aC:H, and is sometimes called "tungsten diamond-like carbon (DLC)". On the rollers, the friction coefficient of the WC-aC:H coating was low enough that the coated rollers 16 could lose fraction with the cam surface 17, and sliding at that interface ensured. Since the WC-aC:H coating is also fairly abrasive to steel, the sliding of the coated roller led to a significant abrasive wearing of the cam surface, and a decreased life cycle of the motor.

A better surface engineering approach to the applicant is to apply the WC-aC:H coating to the piston 15 surface and to improve the surface finish of the roller 16 through a vibratory finishing process. The coating on the piston surface provides a low friction coefficient at the roller-piston intrface that in turn inhibits the loss of traction at the roller-cam interface. The coating on the piston also provides protection to scuffing which can occur between the piston and the cylinder wall interface. This added scuffing protection provided by the coating allows the manufacturer to fabricate the piston from a less expensive alloy than the originally chosen gray cast iron, such as 52100. The original choice of gray cast iron for the pistons compromised cost and mechanical strength for its modes resistance to scuffing. The improved roller finish correlates with a greater lubricant film thickness, and therefore less wear of the cam surface and a longer motor life.

Axial Piston Motors

Figure 3:
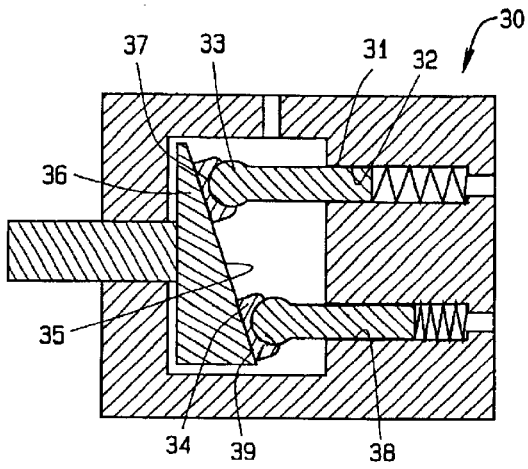
FIG. 3 shows its application to a radial piston motor or pump.

FIG. 3 shows an axial piston motor 30 in which pistons 31 reciprocate in cylinders 32. The piston heads 33 are engaged in sockets 34 which are slidable on the inclined surface 35 of a tilt plate 36.

In the axial piston motors of FIG. 3, sliding contact exists at the piston-socket interface 37, the piston-cylinder interface 38, and the socket-plate interface 39. To inhibit adhesive wear at two of the contacts, the socket 34 is sometimes constructed of a dissimilar material. For example, while the pistons 31 and the plate 36 are usually made from a hardened steel alloy, the sockets 34 may be constructed of a brass alloy. Under normal operating conditions, there is a sufficient amount of lubrication present, and the axial piston motors perform well. Occasionally, the lubrication film at the sliding contacts will break down, or become marginalized in some way. When that occurs, severe wear can occur at the sliding contacts. Scuffing can occur at the piston-cylinder interface 38, and galling can occur at the socket-plate interface 39. However, a particularly problematic occurrence of galling can arise between steel pistons 31 and brass sockets 34 during these periods of marginalized lubrication. The galling mechanism is triggered by the heat generated at the piston-socket interface 37 that can become sufficient to degrade or damage the surface of the socket 34 during the absence of a lubricating film. The socket material can then transfer onto the piston surface 31, and become lodged there. Once the socket material has established residence on the piston surface 31, adhesive wear initiates between the socket surface 34 and the transferred socket material on the piston surface 31. The adhesive wear accelerates the transfer rate of material from the socket 34 to the piston surface 31, and galling rapidly ensues.

Figure 3A:
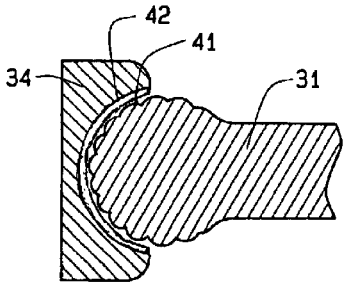
Figure 3B:
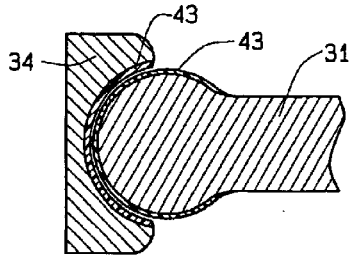
Figure 4:
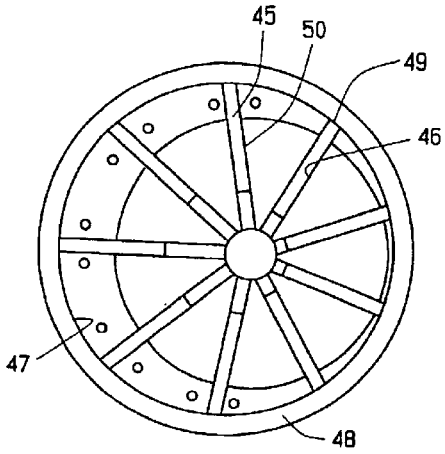
FIG. 4 shows its application to a vane motor or pump.
Figure 5:
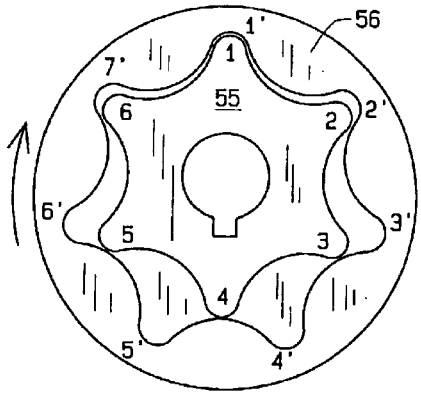
FIG. 5 shows its application to a gear motor or pump.

Galling during periods of marginalized lubrication is overcome by the application of an engineered surface treatment or treatments to the piston 31 and/or the socket 34. A texture modification process that provides dimples 41 or grooves 42 in the surface of one or more of the contacts while maintaining adequate load bearing capacity inhibits galling for short periods of marginalized lubrication (FIG. 3*a*). The dimples 41 and grooves 42 generated in the surface texture can form pockets for lubricant retention. During extended periods of marginalized lubrication, a tribological coating 43 (FIG. 3*b*) applied to one or both contacts is required. The requirements of the tribological coatings 43 are (1) that they maintain a low friction coefficient at the piston-socket interface, (2) have no chemical affinity for the socket material, (3) are not abrasive, and (4) have a smooth surface texture.

EXAMPLE NO. 2

As a specific example of surface engineering applied to an axle piston motor, marginalized lubrication was occurring sporadically in a motor leading to excessive wear and galling between the brass sockets 34 and the plate surface 35. In an attempt to solve this problem, the manufacturer tried to coat the sockets with a WC-aC:H coating. This coating does not adhere well to brass materials, so the manufacturer made sockets out of a 52100 steel alloy and then applied to coating. The coated steel sockets did seem to eliminate the galling at the socket-plate interface 39, but friction and wear increased at the piston-socket interface 37. The overall result was that the efficiency of the motor was substantially decreased with this approach.

A better surface engineering approach to this problem is to apply another type of amorphous hydrocarbon coating to the plate 36. Instead of the WC-aC:H coating that the manufacturer originally tried on the steel sockets, a TIC-aC:H coating is applied to the plate surface 35. The TIC-aC:H coating is more than 2 times less abrasive to brass. This means that when a marginalized lubrication event occurs, the TIC-a:C:H coating inhibits potential galling between the brass sockets 34 and the plate 36, does not seriously wear the brass socket surface 37, and maintains a low sliding friction coefficient at the socket-plate interface 37.

Vane Motors and Pump

In hydraulic vane motors and pumps (FIG. 4), sliding contact exists between the vanes 45 and the rotor cylinders 46, and between the vanes 45 and the inner surface 47 of the chamber housing 48. Generally, there is very little lubrication present at the sliding contacts, so scuffing and/or galling can occur, especially during relatively high-speed operation. Engineered surface treatments that inhibit scuffing and/or galling are be useful in expanding the operational range of hydraulic vane motors and pumps.

In particular, a preferred engineered surface treatment is texture modification, such as dimples or grooves, formed in the inner surface 47 of the chamber wall 48 or on the vane ends 49. Similar texture modification can be done to the vane surfaces 50 or to the walls of the cylinders 46.

Gear Motors and Pumps

In gear motors and pumps (FIG. 5), sliding contact exists between meshing gears 55 and 56. The inner gear 55 has six external gear teeth 1–6 and the outer gear 56 has seven internal gear teeth 1'–7'. As the gears 55, 56 rotate relative to each other, the surfaces of the teeth 1–6 and 1'–7' engage. At low speeds, the tribological concern is adhesive wear due to poor lubrication. Engineered surface treatments that provide barriers to adhesive wear of the sliding contacts enhance the operational performance of gear motors and pumps. At high speeds, the lubricant film can also break down if the temperature in the contact zone exceeds the flash temperature of the lubricant. In this case, a tribological coating is required to provide protection against high speed scuffing.

Gear Motors and Pumps with Rollers

Figure 6:
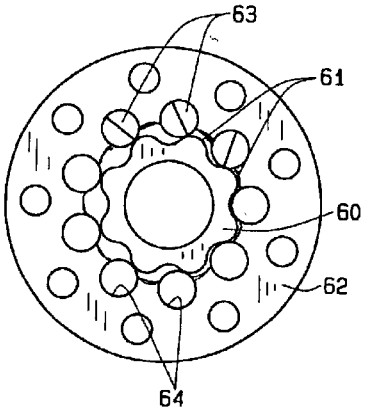
FIG. 6 shows its application to a gear motor or pump with rollers.

FIG. 6 shows a typical arrangement of a gear motor or gear pump with rollers. The structure comprises an inner gear wheel 60 which, as shown, has eight gear teeth 61. A roller retainer 62 surrounds the gear wheel 60 and holds nine rollers 63 in pockets 64.

Rolling contact exists at the roller 63—gear wheel 60 interface. Engineered surface treatments that increase the fatigue life of the rolling contacts are useful in extending the operational life and load bearing capability of these types of gear motors and pumps. Sliding contact exists at the roller 63—retainer pocket 64 interface. During low speed, high torque operation, the rollers 63 may stick at the roller-retainer interface, causing the rollers 63 to slide or skid on the surface of the gear wheel 60 surface. The sliding of the rollers 63 on the gear wheel surface 60 is a highly adhesive wear condition. The engineered surface solution for this situation is to apply treatments to decrease the ability of the rollers 63 to stick in the retainer 62, while at the same time promoting rolling of the rollers 63 on the surface of the gear wheel 60. For example, a suitable tribological coating and/or texture modification applied to the retainer 62 inhibits the ability of the rollers 63 to stick to the retainer 62. However, a low friction tribological coating applied to the rollers 63 inhibits sticking to the retainer 62, and also promotes sliding of the rollers 63 on the gear wheel 60.

In view of the above, it will be seen that the several objects and advantages of the present invention have been achieved and other advantageous results have been obtained.

What is claimed is:

1. A method of increasing the torque rating and machine life for a hydraulic motor or pump having both rolling and sliding contact surfaces comprising the steps of applying predetermined engineered surface treatments to both said rolling and said sliding contact surfaces in said hydraulic motor or pump, the engineered surface treatments comprising both texture modifications and tribological coatings, the texture modifications being selected from mechanical vibratory finishing, chemical-mechanical vibratory finishing, laser texturing, and mechanical dimpling and the tribological coatings being selected from the group consisting of doped amorphous carbons, undoped amorphous carbons, amorphous hydrocarbons, metal carbides, metal nitrides, metal oxides, metal dichalcogenides, and metal borides.

2. The method of claim 1 including the step of applying the engineered surface treatments to components of radial piston motors or pumps to provide wear resistance for low speed high torque operation.

3. In a radial piston motor or pump wherein an outer cam ring having an inwardly directed undulated cam surface surrounds an inner cylinder block that has radially outwardly directed cylinders and pistons with cam rollers in said cylinders, with the cam ring and cylinder block being relatively rotatable such that there is rolling contact between the cam rollers and the cam surface and sliding contact between the rollers and the pistons, the improvement which comprises a low friction coating on the piston where it engages the roller to reduce $\lambda$ and adhesive wear between the piston and roller and a texture modification to the roller body to increase $\lambda$ and decrease wear between the roller and cam surface.

4. The improvement of claim 3 wherein the low friction coating is selected from the group consisting of doped amorphous carbons, undoped amorphous carbons, amorphous hydrocarbons, metal carbides, metal nitrides, metal oxides, metal dichalcogenides, and metal borides and the texture modification is selected from mechanical vibratory finishing, chemical-mechanical vibratory finishing, laser texturing, stone honing, and mechanical dimpling.

* * * * *